US005608938A

United States Patent [19]

Baschenis

[11] Patent Number: 5,608,938

[45] Date of Patent: Mar. 11, 1997

[54] BOTTLE BRUSH ASSEMBLY

[76] Inventor: Bruno Baschenis, c/o Ike Keao, Ltd., 13 Bluebird La., Aliso Viejo, Calif. 92656

[21] Appl. No.: 590,036

[22] Filed: Feb. 8, 1996

[51] Int. Cl.[6] ..... A47L 15/37

[52] U.S. Cl. ..... 15/68; 15/164; 74/89.15; 446/241

[58] Field of Search ..... 15/56, 59, 65–68, 15/164, 165; 74/89.15; 446/241, 259

[56] References Cited

U.S. PATENT DOCUMENTS

| | | | |
|---|---|---|---|
| D. 250,068 | 10/1978 | Dacotey . | |
| D. 286,468 | 11/1986 | Fuchs . | |
| D. 334,287 | 3/1993 | Ingles . | |
| D. 335,223 | 5/1993 | Shumway et al. . | |
| D. 335,770 | 5/1993 | McGregor . | |
| D. 336,160 | 6/1993 | Shumway et al. . | |
| 1,276,874 | 8/1918 | Clarke | 15/65 |
| 1,507,971 | 9/1924 | Lomp | 15/65 |
| 1,680,713 | 8/1928 | Wittenberg | 15/65 |
| 2,792,579 | 5/1957 | Roy | 15/65 |
| 3,750,214 | 8/1973 | Caliendo | 15/165 |
| 3,862,461 | 1/1975 | Bucklitzsch . | |
| 4,184,222 | 1/1980 | Wootten . | |
| 4,455,781 | 6/1984 | Blumenthal | 446/241 |
| 4,502,176 | 3/1985 | Wallace . | |
| 4,837,887 | 6/1989 | McLaughlin . | |
| 5,033,155 | 7/1991 | Klotz . | |
| 5,339,480 | 8/1994 | Murg et al. . | |
| 5,435,040 | 7/1995 | McClure . | |

FOREIGN PATENT DOCUMENTS

| | | | |
|---|---|---|---|
| 454990 | 2/1950 | Italy | 15/164 |

*Primary Examiner*—David Scherbel
*Assistant Examiner*—Terrence Till
*Attorney, Agent, or Firm*—James G. O'Neill

[57] ABSTRACT

A brush assembly for the improved cleaning of the interior of a bottle includes a cap having a central opening and a twisted, elongated stem passing through the central opening. The stem has a brush assembly at one end and an operating assembly at the other end, and with the brush assembly mounted in a bottle, the pushing or pulling of the operating means will push or pull the twisted, elongated stem through the central opening in the cap so as to automatically rotate the brush.

11 Claims, 1 Drawing Sheet

BOTTLE BRUSH ASSEMBLY

BACKGROUND OF THE INVENTION

1. Field of the Invention

This invention relates generally to bottle brushes, and more particularly, to an improved bottle brush for more easily and effectively cleaning the interior a bottle.

2. Description of Prior Art

As is well known, reusable bottles, such as glass or plastic baby bottles used for feeding young children and laboratory bottles used to hold various specimens, must be clean and sterile. Unclean bottles are both unsightly and could cause problems, such as illness in young children, or improper results when used in a laboratory or clinical setting.

Because of this recognized need, there are many types of bottle cleaners available used to clean the interior of a bottle. These bottle brushes take many forms, but generally consist of a single strand of twisted wire with a number of bristles secured at one end so as to radiate outwardly to provide a cylindrical cleaning brush that is inserted into the interior of a bottle to try to clean the same. The known brushes, however, do not adequately clean all bottles, and for this reason, a need still exists in the art for a brush which will overcome known problems with cleaning bottles.

One attempt to provide an improved brush for cleaning a bottle is set forth in U.S. Pat. No. 3,862,461 to Bucklitzsch, which discloses a cleaning brush having an elongated supporting member with a crank type arm at the outer end and a brush member formed at the bottom end. The brush member is made of resilient flexible bristles divided into an upper generally cylindrical portion and a lower frustroconical portion, with the bristles getting progressively larger down towards the bottom of the brush. A handle is mounted on the crank type arm at the outer end of the elongated supporting member and the handle is turned with the brush in the interior of a bottle so that the bristles engage the walls, etc. of the interior of the bottle so as to scrub the interior thereof.

Other types of cleaning devices and/or are bottle brushes are disclosed in U.S. Pat. Nos. 4,184,222, 4,502,176, 4,837,887, 5,033,155, 5,339,480, 5,435,040, U.S. Des. Nos. 250,068, 286,465, 334,287, 335,223, 335,770 and 336,160. The prior art devices, or cleaners, shown in these patents, however, do not solve all known problems. Furthermore, in the present climate of increased interest in health and fear of contamination, there still exists a need in the art for an improved bottle cleaning brush and, in particular, a brush for cleaning the interior of a baby bottle. In addition, there is a need in the art for a simple to manufacture baby bottle cleaning brush which is also easy to use and which may not be readily set aside or lost.

SUMMARY OF THE INVENTION

Accordingly, it is a general object of the present invention to provide an improved brush for cleaning bottles. It is a particular object of the present invention to provide an improved bottle brush which is easy to manufacture, assemble and use. It a still more particular object of the present invention to provide an improved brush assembly for cleaning bottles which may be mounted on and secured to a bottle. It is a still more particular object of the present invention to provide a combination bottle and bottle brush assembly, including a cap. It is yet another object of the present invention to provide an improved baby bottle brush assembly which automatically rotates the brush in the bottle as the brush is pushed into or withdrawn from the bottle. And, it is yet a further object of the present invention to provide an improved combination baby bottle and brush assembly which are held together in such a manner that the bottle may be easily and automatically cleaned by the brush.

In accordance with one aspect of the present invention, there is provided a bottle brush assembly having a cap which may be screw threaded on a bottle and which cap has a slotted opening therein holding an elongated twisted member supporting a brush at one end and an operating means at the other end. The brush, upon insertion into, and withdrawal from a bottle, will be automatically rotated to clean the entire interior surface of the bottle.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DETAILED DESCRIPTION OF THE PREFERRED EMBODIMENT

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved bottle brush assembly for mounting to a bottle. For reasons of explanation only, and not by way of limitation, the bottle brush assembly described and shown herein are for baby bottles. It is to be understood, of course, that the present invention provides a brush assembly means that may be used in any existing or known type of reusable type of bottle to which a cap may be applied or secured.

Figure 1:
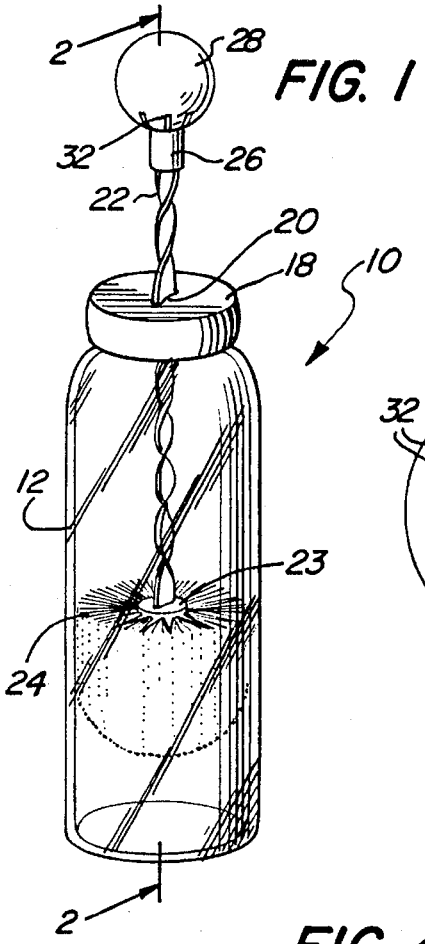
FIG. 1 is a perspective view of a novel bottle brush assembly of the present invention mounted to a bottle, with an elongated stem of the brush assembly shown partially extending through a cap.
Figure 3:
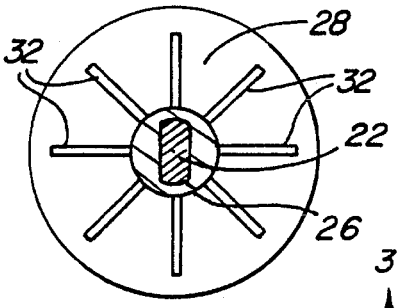
FIG. 3 is a cross-sectional view of an operating handle of the brush assembly, taken along line 4—4 in FIG. 2.
Figure 2:
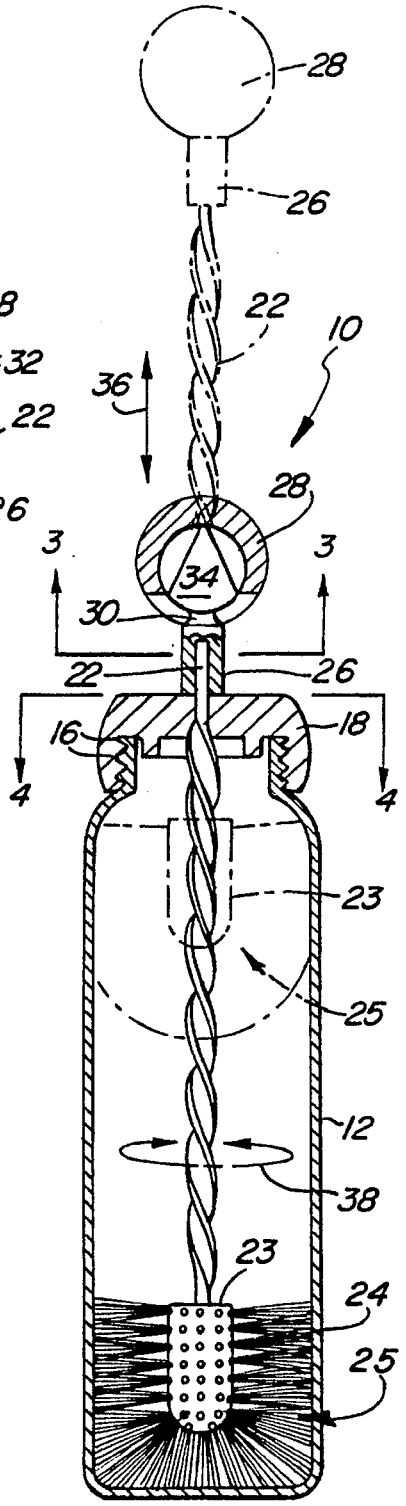
FIG. 2 is a cross-sectional view of the bottle brush assembly and bottle taken along line 2—2 in FIG. 1.
Figure 4:
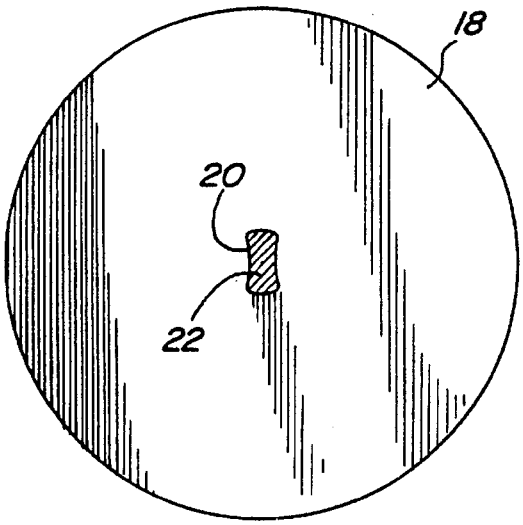
FIG. 4 is a cross-sectional view taken along line 3—3 of FIG. 2.

Turning now to the drawings and particularly to FIGS. 1 and 2, one embodiment of the bottle brush assembly and bottle of the present invention is shown at 10. A bottle 12, which may have any desired shape and which may be made of any desired material, such as glass or plastic, and which may be clear or opaque, preferably has a reduced diameter end or neck portion 16 having threads or other securing means formed on the exterior thereof. A cap or closure member 18 having a slotted central opening 20 formed centrally thereof is secured to the threaded neck portion 16. An elongated, substantially rectangular, twisted stem element 22 travels through central opening 20, as explained more fully below. An inner end of the twisted stem 22, i.e., the end held within the bottle 12, is preferably secured to an elongated, perforated bristle holding element 23, and a plurality of soft bristles 24 are secured and held in this holding element 23 to form a brush means 25. The brush means 25 is sized and dimensioned so as to tightly fit into the interior of the bottle and to scrub the same clean upon actuation thereof, as explained more fully below. The outer or other end of the elongated twisted stem 22, outside of the cap 18, is securely held in an operating holding means 26 having an operating means 28 rotatably mounted thereon, as by means of a reduced diameter portion 30 formed on the holding means 26.

The operating means 28 is preferably formed in the shape of a ball and includes a plurality of slots 32 formed on a lower surface thereof, so as to form a plurality of fingers around an opening in the ball, into which a shaped end 34 of operating holding means is inserted and held. That is, the shaped end 34 of holding means 26 is forced into the opening in the lower surface of the operating ball 28 until it passes by ends of the fingers between the slots 32 where it is captured and held within the hollow interior of the ball by the action of the ends of the fingers held in the reduced diameter portion 30. This mounting of the operating means 28 on the holding means 26 allows the twisted stem 22 and brush 25 to be rotatably held thereon, as explained more fully below. As shown, the operating means 28 is preferably formed so as to be a hollow sphere and is made from plastic or other resilient material to allow the shaped head portion 34 of the holding means 26 to be inserted therein in such a manner that the operating means 28 is rotatably mounted thereon.

With the elements of the bottle brush assembly of the present invention mounted to a bottle 12 as shown in FIGS. 1 and 2 of the drawings, an explanation of how the present invention works will now be set forth. In particular, as the operating means or ball 28 is raised and lowered in the direction of the arrow 36 (see FIG. 2) by the hand of a user, the holding means 26 rotatably secured within the operating means will be pulled upwardly or pushed downwardly. This movement of the operating means 28 will then either pull up or push down the twisted elongated stem element 22 through the central slot 20 in cap 18. Therefore, as long as the operating ball 28 is grasped in the hand of a user, this upward or downward force will cause the holding means 26 to turn or rotate by the action of the twisted stem 20 being pushed or pulled through the opening 20 in cap 18. This action also automatically rotates the holding element 23 secured to the interior end of the twisted stem 22, thereby automatically rotating the brush 25 in the direction of the arrow 38 (see FIG. 2), depending on whether the twisted stem element is being withdrawn from or pushed into the bottle. With the cap 18 securely in place on the bottle 12, the operating ball 28 may be moved between the solid and broken line positions shown in FIG. 2 to enable the brush 25 to be rotatively moved between the solid and broken line positions within the bottle 12, thereby scrubbing the entire interior of the bottle from the top to the bottom. This cleaning movement of the brush in the bottle may even be conveniently accomplished by a single hand of a user, such as when a mother is carrying an infant in one arm, if the bottle is supported on a flat surface.

As described above, the inventive assembly of the present invention includes a closure means or cap and a brush assembly which is automatically rotated within a bottle to which the assembly is mounted by the cap, by the action of a rotatable operating means being moved between vertical positions. The bottle brush assembly of the present invention is easy to manufacture and use either when held in two hands of a user, or one handed when placed on a flat surface. The vertical movement, i.e., the raising and lowering of the operating means 28 raises and lowers the cleaning brush 25 while simultaneously rotating the brush as it is moved up and down within the interior of a bottle.

Thus, it can be seen that the bottle and brush assembly of the present invention provides a brush assembly that may be mounted to an existing bottle, such as baby bottles with similar threaded reduced diameter upper ends, or may be sold as a unit with the bottle and brush assembly secured together. When it is desired to use the bottle after cleaning, the cap and brush assembly are removed, and a further cap with the necessary nipple, etc., is secured to the bottle for use by a baby or the like.

Those skilled in the art will appreciate that various adaptations and modifications of the just-described preferred embodiments can be configured without departing from the scope and spirit of the invention. Therefore it is to be understood that, within the scope of the appended claims, the invention may be practiced other than what is specifically described herein.

What I claim is:

1. A brush assembly for cleaning the interior of a bottle, comprising, in combination:

a closure means for mounting on an opening in a bottle the interior of which is to be cleaned;

an opening formed in said closure means;

an elongated, rectangular, twisted stem means having two ends passing through and movably held in said opening in said closure means;

a hollow sphere operating means;

an operating holding means fixed to a first of said two ends of said elongated rectangular, twisted stem means;

said operating holding means having a shaped end, and said hollow sphere operating means rotatably captured in said shaped end; and a brush mounted on a second of said two ends of said elongated, rectangular, twisted stem means.

2. The brush assembly of claim 1 wherein said closure means is a cap having screw threads therein, whereby said cap may be screwed onto threads formed on said opening of said bottle.

3. The brush assembly of claim 2 wherein said opening in said closure means is a slot.

4. The brush assembly of claim 1 wherein said opening in said closure means is a slot.

5. The brush assembly of claim 4 wherein said brush is secured to a brush holding means secured to said second of said two ends.

6. The brush assembly of claim 5 wherein said ball shaped operating holding means includes a plurality of resilient finger means having ends which are captured in said reduced diameter portion.

7. The brush assembly of claim 1 wherein said ball shaped operating holding means includes a plurality of resilient finger means having ends which are captured in said reduced diameter portion.

8. A brush assembly for cleaning the interior of a bottle, comprising, in combination:

a cap for mounting on an opening in a bottle, the interior of which is to be cleaned; said cap having screw threads formed internally therein, whereby said cap may be screwed onto threads formed on the exterior of said opening of said bottle;

a slotted opening formed in said cap;

a rectangular, twisted, elongated stem means having two ends passing through and movably held in said slotted opening in said cap;

an operating holding means having a shaped end fixed to a first of said two ends;

a ball shaped operating means, rotatably captured in a reduced diameter portion of said operating holding means; and a bristle holding means mounted on a second of said two ends of said rectangular, twisted, elongated stem means, and a plurality of bristles held in said bristle holding means to form a brush.

9. The brush assembly of claim 8 wherein said ball shaped operating holding means includes a plurality of resilient finger means having ends which are captured in said reduced diameter portion.

10. A combination baby bottle and brush assembly for cleaning the interior of said baby bottle, comprising:

said baby bottle having a top opening;

a cap mounted on said top opening; said cap having screw threads formed internally therein, and said bottle having screw threads formed externally around said opening, whereby said cap is screwed onto said bottle;

a slotted opening formed in said cap;

a rectangular, twisted, elongated stem means having two ends passing through and movably held in said slotted opening;

an operating holding means secured to a first of said two ends of said rectangular, twisted, elongated stem means;

a sphere-shaped operating means, rotatably held on a reduced diameter portion of said operating holding means, around a shaped end thereof; and a bristle holding means mounted on a second of said two ends of said elongated stem means, and a plurality of bristles held in said bristle holding means to form a brush.

11. The brush assembly of claim 10 wherein said sphere-shaped operating means is hollow and includes a plurality of resilient finger means having ends which are captured in said reduced diameter portion.

* * * * *